US009380900B2

(12) United States Patent
Tehensky

(10) Patent No.: US 9,380,900 B2
(45) Date of Patent: Jul. 5, 2016

(54) RESERVOIR COASTER

(76) Inventor: Michael Tehensky, Toledo, OH (US)

( * ) Notice: Subject to any disclaimer, the term of this patent is extended or adjusted under 35 U.S.C. 154(b) by 34 days.

(21) Appl. No.: 13/409,188

(22) Filed: Mar. 1, 2012

(65) Prior Publication Data

US 2012/0223208 A1 Sep. 6, 2012

Related U.S. Application Data

(60) Provisional application No. 61/448,424, filed on Mar. 2, 2011.

(51) Int. Cl.
*A47G 23/03* (2006.01)

(52) U.S. Cl.
CPC ..... *A47G 23/03* (2013.01)

(58) Field of Classification Search
CPC ..... A47G 23/03; A47G 23/0316; A47G 23/0306; A47G 23/0309; A47G 23/0313
USPC ..... 248/346.11, 346.03, 346.01; 220/737–739, 630, 628; 215/386, 215/392–395; D7/619.1, 624.1, 625
See application file for complete search history.

(56) References Cited

U.S. PATENT DOCUMENTS 145,815 A * 12/1873 Price ..... A47G 23/03 220/DIG. 21
1,554,789 A * 9/1925 Crary ..... 401/28
2,989,205 A * 6/1961 Yaws ..... 248/346.11
3,144,231 A * 8/1964 Scully ..... 248/110
3,188,040 A * 6/1965 Eichler ..... A47G 23/03 215/393
3,257,092 A * 6/1966 Blundell ..... A47G 23/03 215/394
3,268,198 A * 8/1966 Swett ..... 248/346.11
3,363,869 A * 1/1968 Blundell ..... 248/346.11
D229,655 S * 12/1973 Cyren ..... D7/624.1
3,808,084 A * 4/1974 Doty ..... 248/346.11
4,367,243 A * 1/1983 Brummett ..... A21B 3/13 426/303
4,546,946 A * 10/1985 Jenison ..... A47G 23/03 248/346.11
D286,319 S * 10/1986 Mathis ..... D23/261
4,752,147 A * 6/1988 Persi ..... B05C 17/00 401/123
4,759,524 A * 7/1988 Anderson ..... 248/346.11
4,858,872 A * 8/1989 Witt ..... 248/346.11
4,858,873 A * 8/1989 Wilmoth ..... A47G 23/03 215/394
D317,570 S * 6/1991 Kryk ..... D9/434
5,148,951 A * 9/1992 Moure ..... A45D 40/0075 100/116
5,385,326 A * 1/1995 Bidwell ..... A47G 23/03 220/4.26
5,523,104 A * 6/1996 Kirk ..... A47J 37/105 426/523
5,727,712 A * 3/1998 Costello ..... A47G 19/2211 220/703
D408,227 S * 4/1999 Swann, Jr. ..... D7/624.1
6,089,519 A * 7/2000 Laybourne ..... A47G 23/03 220/212

(Continued)

FOREIGN PATENT DOCUMENTS

FR 1442999 A * 6/1966 ..... A47G 19/2283

*Primary Examiner* — Jonathan Liu
*Assistant Examiner* — Guang H Guan
(74) *Attorney, Agent, or Firm* — Fraser Clemens Martin & Miller LLC; William J. Clemens

(57) ABSTRACT

A beverage coaster includes a hollow main body having an open end. The beverage coaster also includes a top plate with an outer surface and a plurality of apertures formed therein. The top plate is disposed on and covers the open end of the hollow main body to define a reservoir within the hollow main body. The apertures permit fluid communication between the outer surface of the top plate and the reservoir. In operation, the reservoir collects and stores condensation that drains from a beverage container placed on the outer surface of the top plate.

17 Claims, 5 Drawing Sheets

(56) References Cited

U.S. PATENT DOCUMENTS

| | | | | | |
|---|---|---|---|---|---|
| 6,109,583 | A * | 8/2000 | Nunes | 248/346.11 | |
| D491,257 | S * | 6/2004 | Picken, Jr. | D23/366 | |
| 6,789,683 | B1 * | 9/2004 | Fisher | A47J 36/08 | 210/465 |
| 7,017,768 | B2 * | 3/2006 | Iskierka | A47G 19/2211 | 116/207 |
| 7,213,535 | B2 * | 5/2007 | Schmidt | A01K 1/0014 | 119/161 |
| D609,977 | S * | 2/2010 | Gjonaj | D7/624.1 | |
| 8,033,420 | B2 * | 10/2011 | Roseblade | A47G 19/2211 | 220/369 |
| D664,004 | S * | 7/2012 | Benishai | D7/543 | |
| D673,245 | S * | 12/2012 | Cooney | D23/260 | |
| 8,376,304 | B2 * | 2/2013 | Almada | 248/346.11 | |
| D677,994 | S * | 3/2013 | Williams | D7/624.1 | |
| 8,701,262 | B2 * | 4/2014 | Hauf | B23P 11/02 | 29/446 |
| 8,708,303 | B2 * | 4/2014 | Bigelow | A47G 1/162 | 248/475.1 |
| 8,960,626 | B1 * | 2/2015 | Taylor | A47G 23/03 | 248/346.11 |
| D731,859 | S * | 6/2015 | Tehensky | D7/624.1 | |
| 2007/0034766 | A1 * | 2/2007 | Thompson | 248/346.11 | |
| 2012/0223208 | A1 * | 9/2012 | Tehensky | A47G 23/03 | 248/346.11 |

* cited by examiner

RESERVOIR COASTER

CROSS-REFERENCE TO RELATED APPLICATIONS

This application claims the benefit of U.S. Provisional Application No. 61/448,424, filed on Mar. 2, 2011. The entire disclosure of the above application is hereby incorporated herein by reference.

FIELD OF THE INVENTION

The present invention relates generally to a beverage coaster and, more particularly, to a beverage coaster for handling condensation from beverage containers.

BACKGROUND OF THE INVENTION

A beverage coaster is typically used under a beverage container such as a cup, glass, bottle, can, or the like to receive condensation that forms on an exterior of the beverage container. The condensation normally drains down the sides of the beverage container and onto the beverage coaster. In this manner, the beverage coaster militates against the condensation reaching a table top or other surface on which the beverage container is disposed.

Where condensation is generated, the condensation can collect, flow over the beverage coaster, saturate a surface of the beverage container, and drain onto the table top. This undesirably causes water staining of furniture and a dripping of water onto clothing. It is also known that water found on the beverage coaster will undesirably cause the beverage coaster to stick to the beverage container when the beverage container is lifted up to the mouth of a user to drink from.

There is a continuing need for a beverage coaster that handles condensation from a beverage container in a manner that militates against liquid staining of furniture, a dripping of liquid onto clothing, and a sticking of the beverage container to the beverage coaster following drainage of condensation from the beverage container onto the beverage coaster.

SUMMARY OF THE INVENTION

In concordance with the instant disclosure, a beverage coaster that handles condensation from a beverage container in a manner that militates against liquid staining of furniture, a dripping of liquid onto clothing, and a sticking of the beverage container to the beverage coaster following drainage of condensation from the beverage container onto the beverage coaster, is surprisingly discovered.

In one embodiment, a beverage coaster includes a hollow main body and a top plate. The hollow main body has an open end. The top plate has an outer surface and a plurality of apertures formed therein. The top plate is disposed on and covers the open end of the hollow main body. The top plate and the hollow main body define a reservoir. The apertures permit fluid communication between the outer surface of the top plate and the reservoir.

In a further embodiment, the apertures are substantially evenly distributed across the outer surface of the top plate. The plurality of apertures includes a plurality of substantially circular holes. Each of the plurality of substantially circular holes has a diameter of at least about ¼ inch. The reservoir is free of an absorbent material. The outer surface is configured to receive a beverage container on which condensation can form. The reservoir is adapted to collect the condensation during use of the beverage coaster.

In another embodiment, the top plate is affixed to the hollow main body with an adhesive. The hollow man body has a substantially annular sidewall. A portion of the sidewall extends beneath a portion of the plurality of apertures of the top plate. The plurality of apertures includes a plurality of substantially circular holes. Each of the plurality of substantially circular holes has a diameter of at least about ¼ inch, which has unexpectedly been found advantageous for the collection and disposal of condensed water from the beverage container.

In an illustrative embodiment, the disclosure includes a beverage coaster that measures approximately 4" in diameter and which is approximately ½" high. The top of the coaster has approximately 100 circular openings that measure approximately ¼" each, is made of plastic, and allows for any accumulation of condensation on a drink, bottle, or container to drip into the reservoir below the openings.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
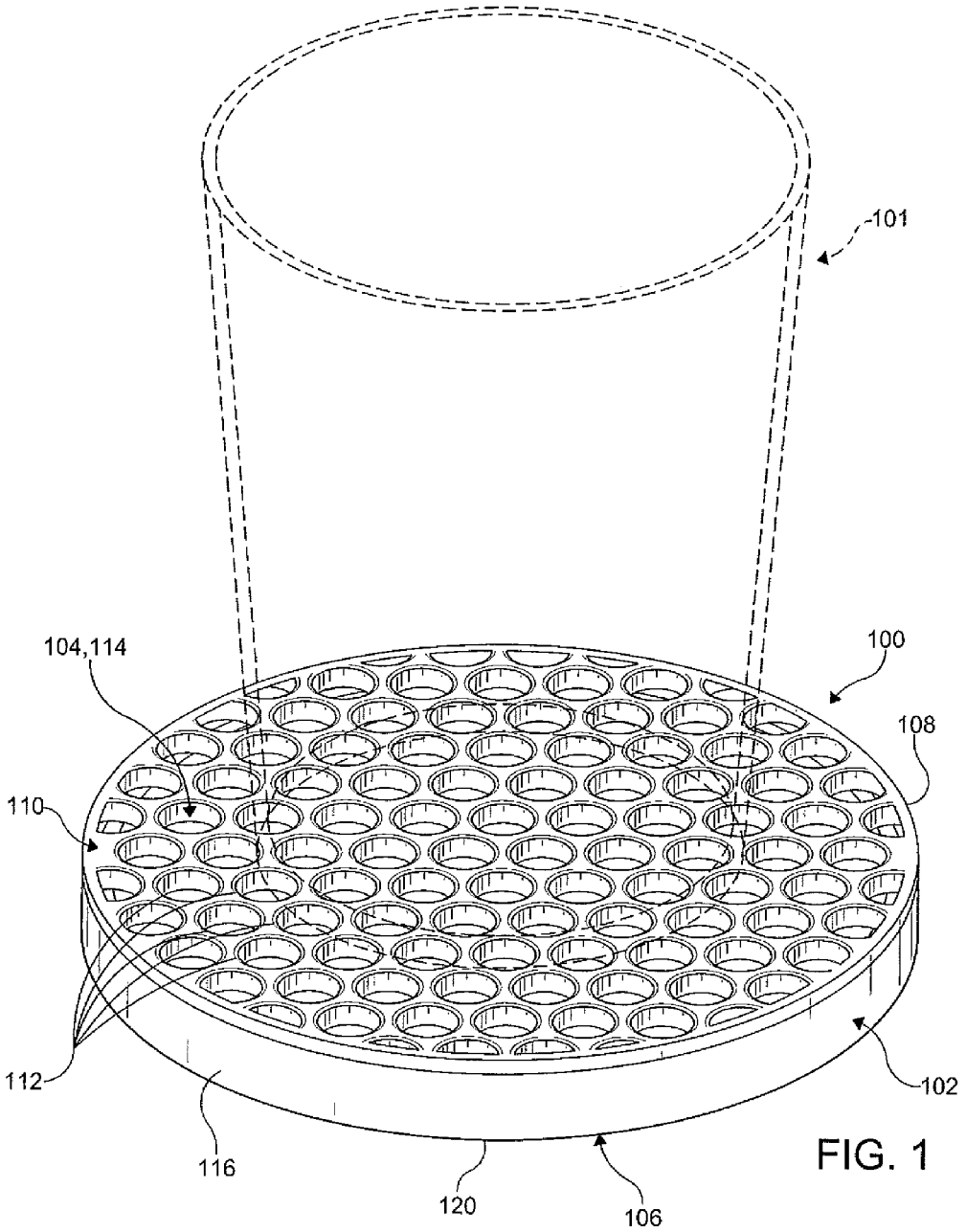
FIG. 1 is a top perspective view of a beverage coaster according to one embodiment of the present disclosure, with a beverage container sitting atop the coaster shown in dashed lines.

The following description is merely exemplary in nature and is not intended to limit the present disclosure, application, or uses. It should be understood that throughout the drawings, corresponding reference numerals also indicate like or corresponding parts and features.

FIGS. 1-4 show a beverage coaster 100 according to one embodiment of the present disclosure. The beverage coaster 100 is configured to hold a beverage container 101, shown in dashed lines in FIG. 1. The beverage coaster 100 is adapted to collect condensation that drains from the beverage container 101 during a use of the beverage coaster 100.

The beverage coaster 100 of the present disclosure includes a hollow main body 102 having an open end 104 and a closed end 106. A top plate 108 is disposed on and covers the open end 104 of the hollow main body 102. The top plate 108 has an outer surface 110 with a plurality of apertures 112 formed therein. The top plate 108 and the hollow main body 102 together define a reservoir 114 inside the beverage coaster 100.

The apertures 112 permit fluid communication between the outer surface 110 of the top plate 108 and the reservoir 114. It should be appreciated that the reservoir 114 may advantageously collect and store condensation drained from an outer surface of the beverage container 101 when the beverage container 101 is placed on the outer surface 110 of the top plate 108.

In particular embodiments, the plurality of apertures 112 is substantially evenly distributed across the outer surface 110 of the top plate 108. Edges of the apertures 112 may be squared, or may be beveled so as to enhance water flow from the outer surface 110 to the reservoir 114. The apertures 112 may be any shape, for example, circular, triangular, or square, as desired. Other distributions and shapes of the apertures 112 may also be used within the scope of the present disclosure.

As shown in FIGS. 1-4, the plurality of apertures 112 may include a plurality of substantially circular holes. Each of the substantially circular holes may have a diameter of at least about ¼ inch, and particularly between ¼ inch and ¾ inch. It has been surprisingly found that holes having a diameter of less than about ¼ inch do not perform as well in draining the condensation from the outer surface 110 of the beverage coaster 100. The subsequent draining of the beverage coaster 100, for example, by shaking the beverage coaster 100 upside down over a sink when the reservoir has been filled with the water condensation, is also facilitated by the size of the holes being at least about ¼ inch in diameter. It has also been found that holes having a diameter of greater than about ¾ inch may provide an overly flexible or weak top plate 108 that is susceptible to bending and cracking.

In certain embodiments, the top plate 108 is affixed to the hollow main body 102 with one of an adhesive, a weld, and a mechanical fastener. Any suitable adhesive that does not degrade or dissolve upon contact with water may be used. Suitable welding techniques include, but are not limited to, sonic welding and the like. Mechanical fasteners such as clips, screws, rivets, and the like may also be employed. Where mechanical fasteners are employed, a polymeric seal member (not shown) may be disposed between the top plate 108 and the hollow main body 102. One of ordinary skill in the art may select any suitable means for affixing the top plate 108 to the hollow main body 102, as desired.

Figure 2:
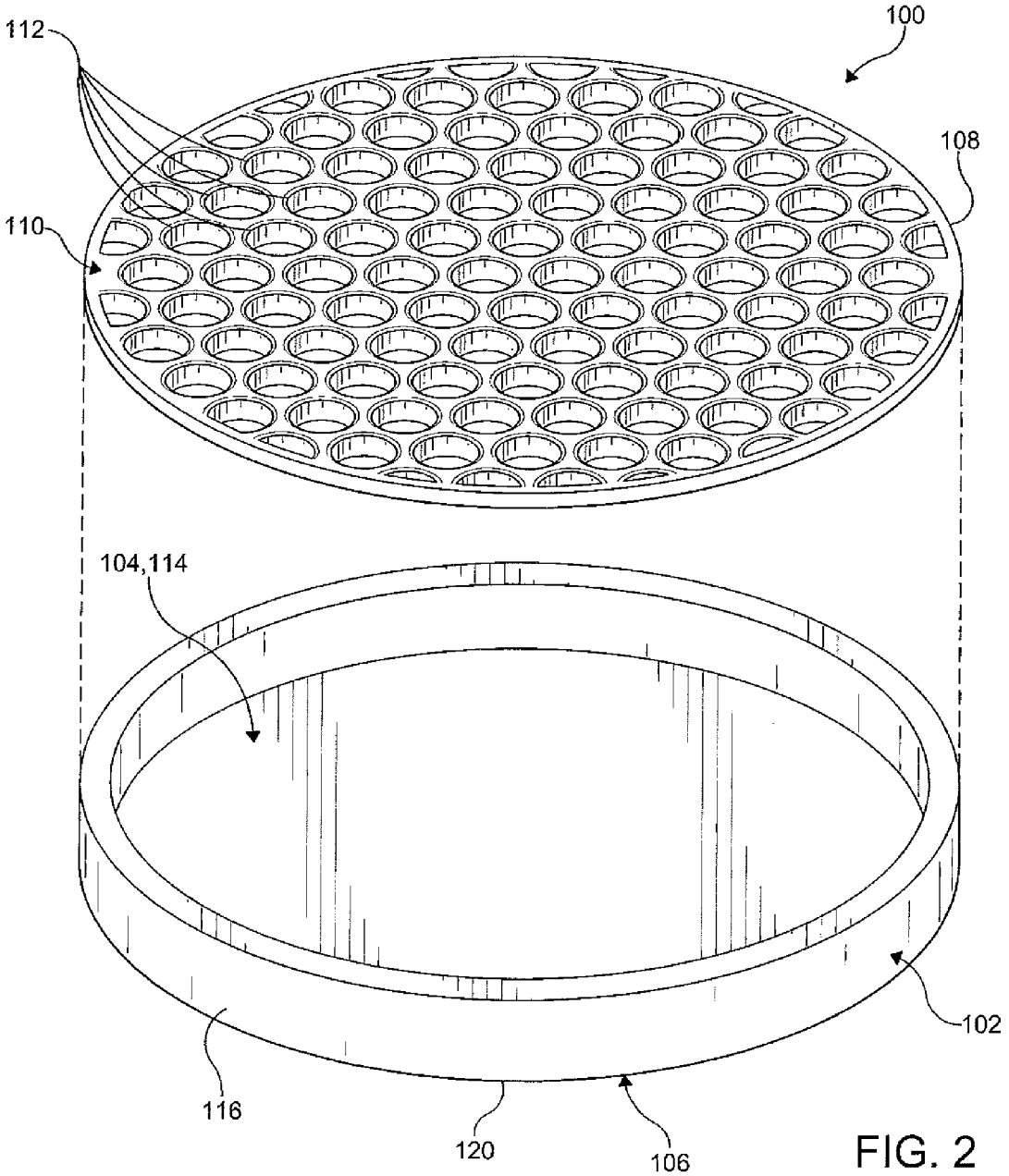
FIG. 2 is an exploded top perspective view of the beverage coaster illustrated in FIG. 1.
Figure 3:
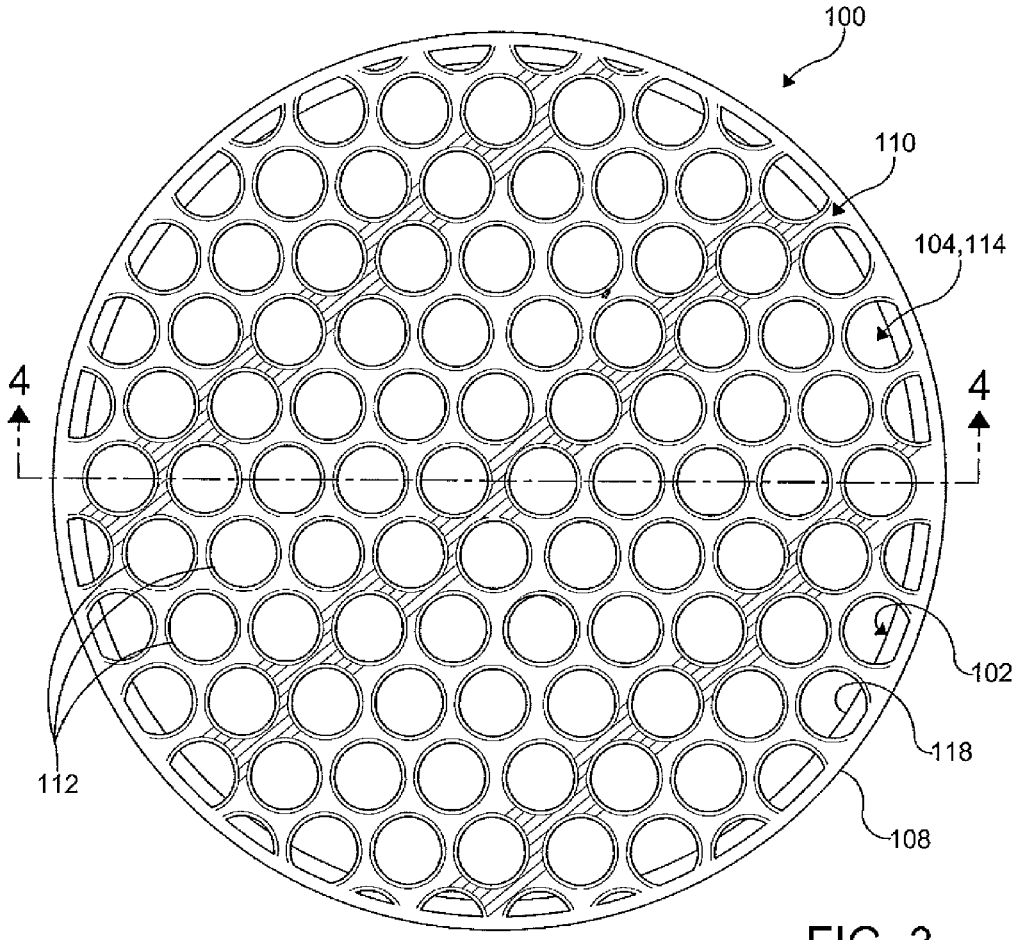
FIG. 3 is a top plan view of the beverage coaster illustrated in FIG. 1.
Figure 4:
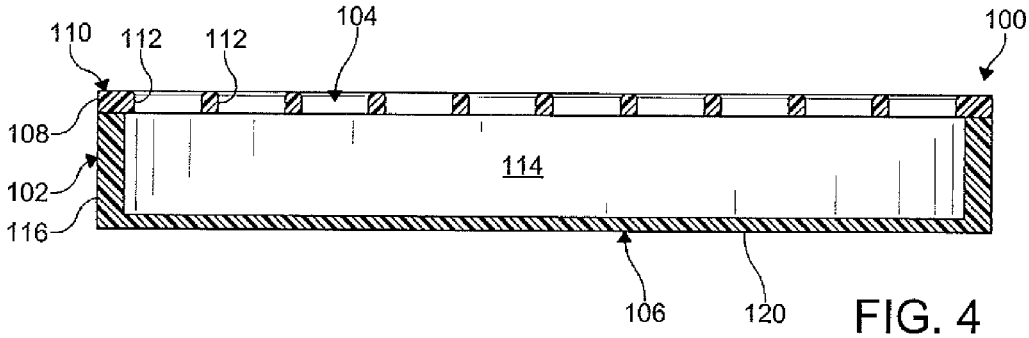
FIG. 4 is a side cross-sectional elevational view of the beverage coaster taken along section line 4-4 in FIG. 3.

Referring to FIGS. 2-4, the hollow main body 102 of the beverage coaster 100 has a sidewall 116. The sidewall 116 of the hollow main body 102 may be substantially annular, or may have any other desired shape such as square, rectangular, hexagonal, and octagonal, as nonlimiting examples. A portion 118 of the sidewall 116 extends beneath a portion of the plurality of apertures 112 of the top plate 108. For example, the portion 118 may be provided by a thickness of the sidewall 116 being sufficiently great compared to a distance between a periphery of the top plate 108 and a nearest one of the apertures 112. The portion 118 of the sidewall 116 provides a desirably large surface for which to affix the top plate 108 to the sidewall 116 of the hollow main body 102.

Figure 5:
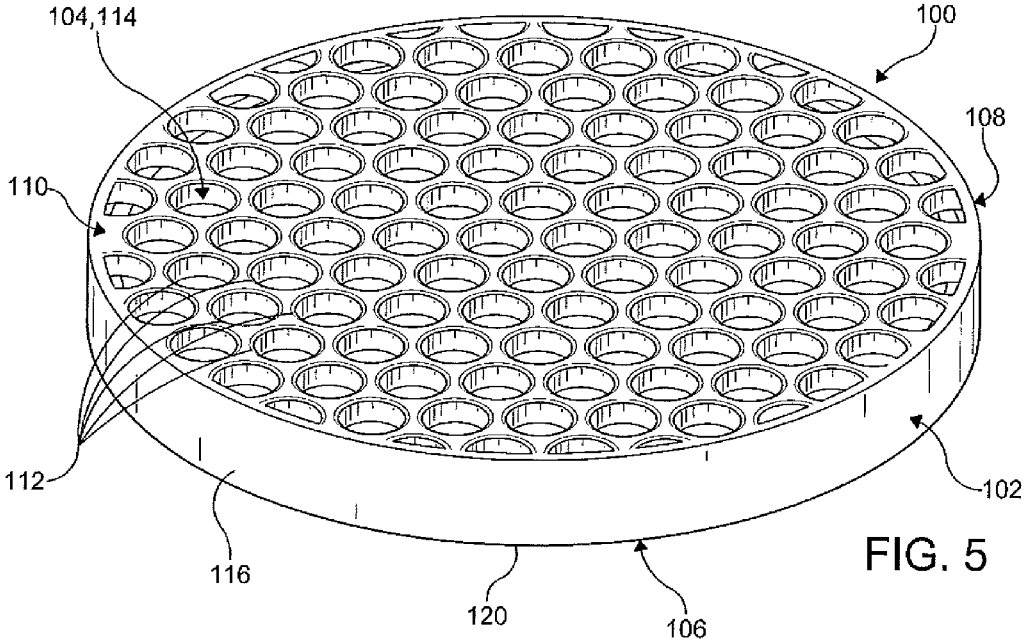
FIG. 5 is a top perspective view of a beverage coaster according to another embodiment of the present disclosure, including a top plate and a hollow main body that are integrally formed.

In another embodiment, illustrated in FIG. 5, the top plate 108 and the hollow main body 102 are integrally formed. As a nonlimiting example, the top plate 108 and the hollow main body 102 may be integrally formed by an injection molding process. Other means for integrally forming the top plate 108 and the hollow main body 102 may also be employed within the scope of the disclosure.

Figure 6:
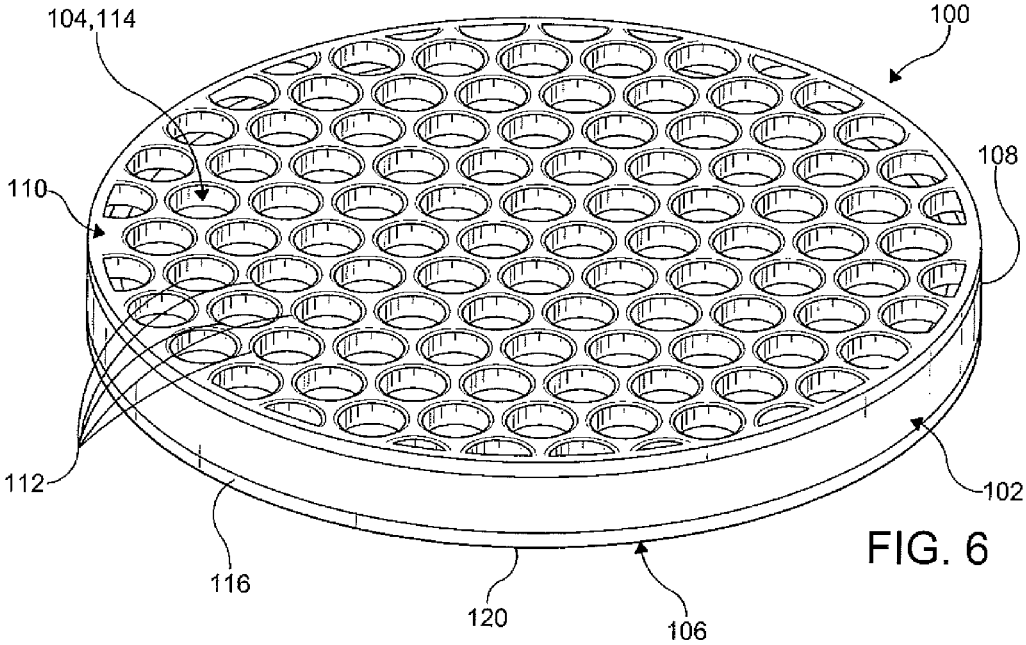
FIG. 6 is a top perspective view of a beverage coaster according to a further embodiment of the present disclosure, including a top plate, an annular sidewall, and a bottom plate that are affixed to form the beverage coaster.
Figure 7:
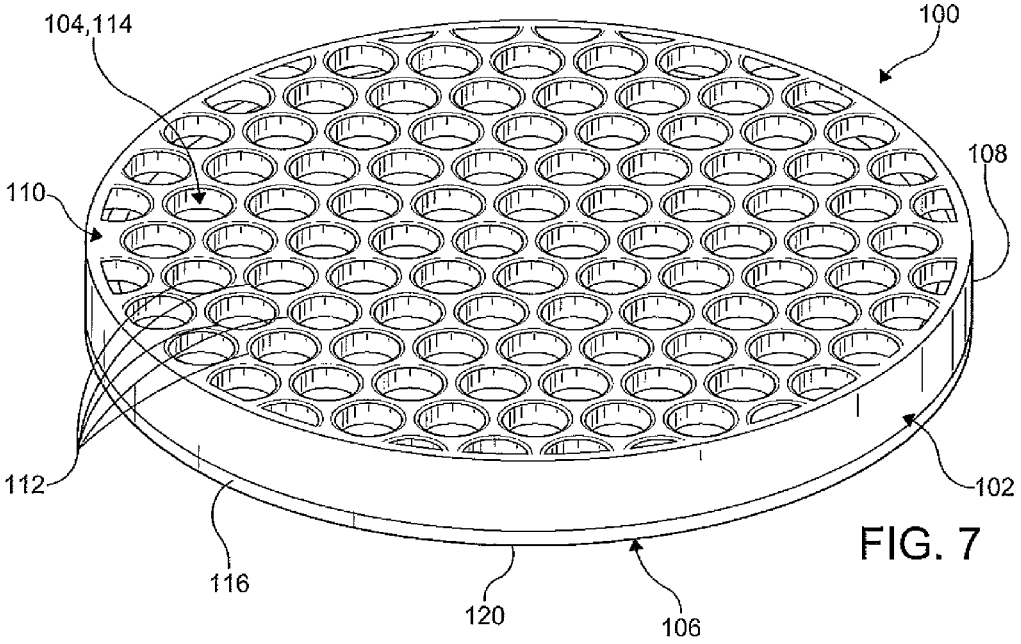
FIG. 7 is a top perspective view of a beverage coaster according to yet another embodiment of the present disclosure.

The hollow main body 102 may further include a bottom plate 120 that provides the closed end 106 of the hollow main body 102. As shown in FIGS. 1-5, the bottom plate 120 may be integral with the sidewall 116 of the hollow main body 102. Alternatively, as shown in FIG. 6, the sidewall 116 may be provided as an annular ring. As shown in FIG. 7, the bottom plate 120 may be provided as separate but affixed to the hollow main body 102. For example, the bottom plate 120 may be affixed to the sidewall 116 with one of an adhesive, a weld, and a mechanical fastener to form the hollow main body 102. In certain embodiments, the bottom plate 120 may be removable, for example, removably affixed with cooperating threads to the sidewall 116, so as to facilitate a cleaning of the inside of the hollow main body 102. One of ordinary skill in the art may select other suitable means for providing the closed end 106 of the hollow main body 102, as desired.

The beverage coaster 100 of the present disclosure is desirably formed from a substantially non-absorbent material. As one nonlimiting example, the substantially non-absorbent material is a plastic. Suitable plastics may include polyethylene, polyvinyl chloride, acrylic, and nylon, as examples. The beverage coaster 100 may be provided in a variety of colors, or may be clear. Other materials that do not degrade or corrode when exposed to water, such as stainless steel, wood, coated metals, composites, ceramics, and the like, may also be used.

In operation, the outer surface 110 of the top plate 108 of the beverage coaster 100 is configured to receive the beverage container 101. For example, a lip (not shown) may be formed at a periphery of the outer surface 110 and surround a base of the beverage container 101 when placed on the beverage coaster 100. The beverage container 101 may be one of a cup, a glass, a bottle, and a can on which condensation can form when the beverage container 101 is chilled.

The reservoir 114 is adapted to collect the condensation during use of the beverage coaster 100. As such the beverage coaster 100 is sized appropriately for receiving the beverage container 101. In particular nonlimiting examples, each of the hollow main body 102 and the top plate 108 is approximately 4" in diameter, and the hollow main body 102 and the top plate 108 are together approximately ½" high. Other suitable sizes for the beverage coaster 100 are also within the scope of the present disclosure.

Advantageously, the reservoir 114 of the instant beverage coaster 100 is free of an absorbent material. Thus, when it is desired to empty the beverage coaster 100 after a period of use, one need only turn the beverage coaster 100 upside down and shake the beverage coaster 100 so as to empty the beverage coaster 100 of its contents. In this manner, the beverage coaster 100 militates against water staining of furniture, a dripping of water onto clothing, and a sticking of the beverage container 101 to the beverage coaster 100 following the drainage of condensation from the beverage container 101 onto the beverage coaster 100.

While certain representative embodiments and details have been shown for purposes of illustrating the invention, it will be apparent to those skilled in the art that various changes may be made without departing from the scope of the disclosure, which is further described in the following appended claims.

What is claimed is:

1. A beverage coaster, comprising:

a hollow main body having a substantially annular sidewall and an open end, the sidewall having a substantially annular upper surface and a continuous side surface defining an outermost perimeter of the main body relative to a center of the main body; and a flat top plate integrally formed with the sidewall to prevent relative movement between the top plate and the sidewall and covering the open end of the main body, the top plate and the main body forming a reservoir, the main body and the top plate being formed from a substantially non-absorbent material, and the reservoir being free from an absorbent material and any interior structure, wherein the top plate has a circular outer surface extending in a single plane and configured to receive a beverage container, the outer surface having a plurality of apertures formed therein, the apertures configured to permit fluid communication between the outer surface of the top plate and the reservoir, wherein the apertures are evenly distributed across the outer surface of the top plate, wherein the apertures include a plurality of substantially circular holes and a plurality of partially circular holes, each of the substantially circular holes being spaced substantially a same minimum distance from more than four others of the apertures, the partially circular holes being positioned adjacent the sidewall of the main body, the substantially circular holes each having a diameter between ¼ inch and ¾ inch, and the upper surface of the sidewall being positioned directly underneath the partially circular holes such that the partially circular holes overlap the upper surface of the sidewall in a vertical direction.

2. The beverage coaster of claim 1, wherein the main body includes a bottom plate affixed to the sidewall.

3. The beverage coaster of claim 1, wherein the main body includes a bottom plate configured to be affixed to the sidewall with one of an adhesive, a weld, and a mechanical fastener to form the main body.

4. The beverage coaster of claim 1, wherein the bottom plate and the sidewall are integrally formed.

5. The beverage coaster of claim 1, wherein the substantially non-absorbent material is a plastic material.

6. The beverage coaster of claim 1, wherein the beverage coaster is configured to receive one of a cup, a glass, a bottle, and a can.

7. The beverage coaster of claim 1, wherein each of the main body and the top plate has a same diameter.

8. The beverage coaster of claim 1, wherein the reservoir is an entirely uninterrupted space disposed inside of the sidewall and extending radially from the center of the main body to and terminating at an inner surface of the sidewall.

9. The beverage coaster of claim 1, wherein the same minimum distance is less than the diameter of each of the substantially circular holes.

10. The beverage coaster of claim 1, wherein an edge of each of the partially circular holes is formed in two arcuate sections of different radii.

11. The beverage coaster of claim 1, wherein the reservoir is adapted to collect condensation draining from the beverage container, and each of the substantially circular holes has a beveled edge at the outer surface of the top plate to enhance flow of the condensation from the outer surface of the top plate to the reservoir.

12. The beverage coaster of claim 1, wherein each of the substantially circular holes is spaced substantially the same minimum distance from six others of the apertures.

13. A beverage coaster, comprising:

a hollow main body having a sidewall and an open end, the sidewall having an upper surface and a continuous side surface defining an outermost perimeter of the main body relative to a center of the main body; and a flat top plate integrally formed with the sidewall to prevent relative movement between the top plate and the sidewall and covering the open end of the main body, the top plate and the main body forming a reservoir, the main body and the top plate being formed from a substantially non-absorbent material, and the reservoir being free from an absorbent material and any interior structure, wherein the top plate has an outer surface extending in a single plane, the outer surface defining an entirety of a surface area inside of the outermost perimeter of the main body, the outer surface having a plurality of apertures formed therein, the apertures configured to permit fluid communication between the outer surface of the top plate and the reservoir, wherein the apertures are evenly distributed across the entirety of the surface area defined by the outer surface of the top plate, wherein the apertures include a first plurality of holes and a second plurality of holes, each of the first plurality of holes being spaced substantially a same minimum distance from more than four others of the apertures, the second plurality of holes being positioned adjacent the sidewall of the main body and each having at least one of a different shape and a different size than each of the first plurality of holes, and the upper surface of the sidewall being positioned directly underneath the second plurality of holes such that the second plurality of holes overlaps the upper surface of the sidewall in a vertical direction, and wherein an entirety of the outer surface of the top plate extends to and terminates at the outermost perimeter of the main body and is continuous, uncovered and disposed in the single plane, and the outer surface is configured to receive a beverage container, the reservoir adapted to collect condensation draining from the beverage container during use of the beverage coaster.

14. The beverage coaster of claim 13, wherein an edge of each of the second plurality of holes is formed in two arcuate sections of different radii.

15. The beverage coaster of claim 13, wherein each of the first plurality of holes has a beveled edge at the outer surface of the top plate to enhance flow of the condensation from the outer surface of the top plate to the reservoir.

16. The beverage coaster of claim 13, wherein each of the first plurality of holes is spaced substantially the same minimum distance from six others of the apertures.

17. A beverage coaster, comprising:

a hollow main body having a sidewall and an open end, the sidewall having an upper surface and a continuous side surface defining an outermost perimeter of the main body; and a top plate integrally formed with the sidewall to prevent relative movement between the top plate and the sidewall and covering the open end of the main body, the top plate and the main body forming a reservoir, the main body and the top plate being formed from a substantially non-absorbent material, and the reservoir being free from an absorbent material and any interior structure, wherein the top plate has an outer surface extending in a single plane and configured to receive a beverage container, the outer surface defining an entirety of a surface area inside of the outermost perimeter of the main body, the entirety of the surface area being available to receive the beverage container, the outer surface having a plurality of apertures formed therein, the apertures configured to permit fluid communication between the outer surface of the top plate and the reservoir, wherein the apertures are evenly distributed across the entirety of the surface area defined by the outer surface of the top plate, and wherein the apertures include a plurality of first holes and a plurality of second holes, the second holes being positioned adjacent the sidewall of the main body and each having at least one of a different shape and a different size than each of the first holes, and the upper surface of the sidewall being positioned directly underneath the second holes such that the second holes overlap the upper surface of the sidewall in a vertical direction.

* * * * *